United States Patent [19]

Freund et al.

[11] 4,278,242

[45] Jul. 14, 1981

[54] BELL-TYPE COIL ANNEALING FURNACE INNER COVER

[75] Inventors: William P. Freund, Lakewood; Stephen R. Hulvey, Medina, both of Ohio

[73] Assignee: The Alloy Engineering Company, Berea, Ohio

[21] Appl. No.: 120,655

[22] Filed: Feb. 11, 1980

[51] Int. Cl.[3] ..... C21D 1/12; C21D 9/00

[52] U.S. Cl. ..... 266/263; 432/254.1

[58] Field of Search ..... 432/254.1, 254.2, 206; 266/262, 263, 264

[56] References Cited

U.S. PATENT DOCUMENTS

| | | | |
|---|---|---|---|
| 1,180,095 | 4/1916 | Wilson | 432/254.2 |
| 2,075,114 | 3/1937 | Hunter et al. | 432/254.2 |
| 2,233,580 | 3/1941 | Breedon et al. | 432/254.2 |
| 2,360,633 | 10/1944 | Allen et al. | 432/254.2 |
| 2,529,609 | 11/1950 | Jacob | 266/263 |
| 3,166,305 | 1/1965 | Troglione et al. | 432/206 |

*Primary Examiner*—John J. Camby

*Attorney, Agent, or Firm*—Watts, Hoffmann, Fisher & Heinke Co.

[57] ABSTRACT

An inner cover for a bell-type annealing or thermal processing furnace having a thin walled cylindrical body formed from textured heat resistant stainless steel and/or nickle chrome alloy closed at its upper end and having one or more outwardly flared conical sections at its other or lower end and terminating in a radial flange surrounded by a steel ring connected thereto.

5 Claims, 2 Drawing Figures

BELL-TYPE COIL ANNEALING FURNACE INNER COVER

BACKGROUND OF THE INVENTION

1. Field of the Invention

This invention relates to inner covers for annealing or thermal processing furnaces.

2. Description of the Prior Art

Bell-type furnaces for annealing or other thermal processing of metal sheet, rod or wire are well known and typically comprise a base structure upon which the metal , generally in coil form, to be treated is supported either on end or by a carrier, a cylindrical-like inner cover closed at its upper end placed over the load its lower end sealed against the escape of an inert gas or other protecting atmosphere circulated therein about the load by a blower or fan incorporated in the base structure, and an insulated generally cylindrical or rectangular furnace bell closed at its top enclosing the inner cover. The furnace bell includes means for heating the enclosed inner cover and load, as desired. The inert or protective atmosphere within the inner cover maintains a non-oxidizing carbon-controlling or other processing atmosphere within the inner cover during the processing of the load.

The lower open end of the inner cover is typically sealed by being imbedded in sand or suitable liquid. Other types of seals utilizing rubber or refractory fiber are also known.

Because of their use inner covers are repeatedly heated and cooled during use. They deteriorate rapidly principally because of the non-uniform expansion and contraction, etc., to which they are subjected during repeated use and thus have a relatively short, useful life. The most rapid deterioration takes place around the lower open ends of the covers and is extremely bad in covers used with direct firing burners.

Covers should be able to withstand the rigors of thermal cycling and mechanical handling but at the same time they should be as light in weight as possible both for efficiency in energy usage (heat transfer) and convenience in handling.

A typical furnace and interior cover of the character to which this invention relates is disclosed in U.S. Pat. No. 2,815,197.

SUMMARY OF THE INVENTION

The present invention provides an inner cover for an annealing or thermal processing furnace of the character referred to so designed and constructed to better stand the repeated expansions and contractions to which it is subjected during uses and thus provide a longer life than prior covers employed for the same purpose. At the same time, the design also provides a cover strong enough to maintain an atmosphere seal and resist handling wear, yet be light in weight for energy efficiency and handling ease.

More specifically, this invention provides an inner cover for a bell-type annealing furnace having a thin walled generally cylindrical body closed at one end made of textured heat resistant stainless steel and/or nickel chrome alloy which resists oxidation, carbonization, formation of carbides, sigma phase and thermal fatigue when subjected to repeated heating and cooling cycles and therefore has a long, useful life. The textured material of the cover provides strength and greater surface area. The greater strength allows use of material of less wall thickness which together with the greater surface area results in enhanced heat transfer from the radiant heaters in the bell to the load being processed. Because of its thin wall the cover heats up quickly and uniformly and cools down quickly and uniformly when air or water is passed over the outside of the cover after the furnace bell is removed at the appropriate temperature. In addition the textured surface of the cover acts to diffuse the flow and increase the effectiveness of water cooling systems when they are used.

Further objects and advantages of the improved inner cover will be hereinafter referred to and/or will be apparent to those skilled in the art to which the invention relates from the following description of the preferred embodiment of the invention depicted in the accompanying drawing.

DESCRIPTION OF THE PREFERRED EMBODIMENT

Figure 1:
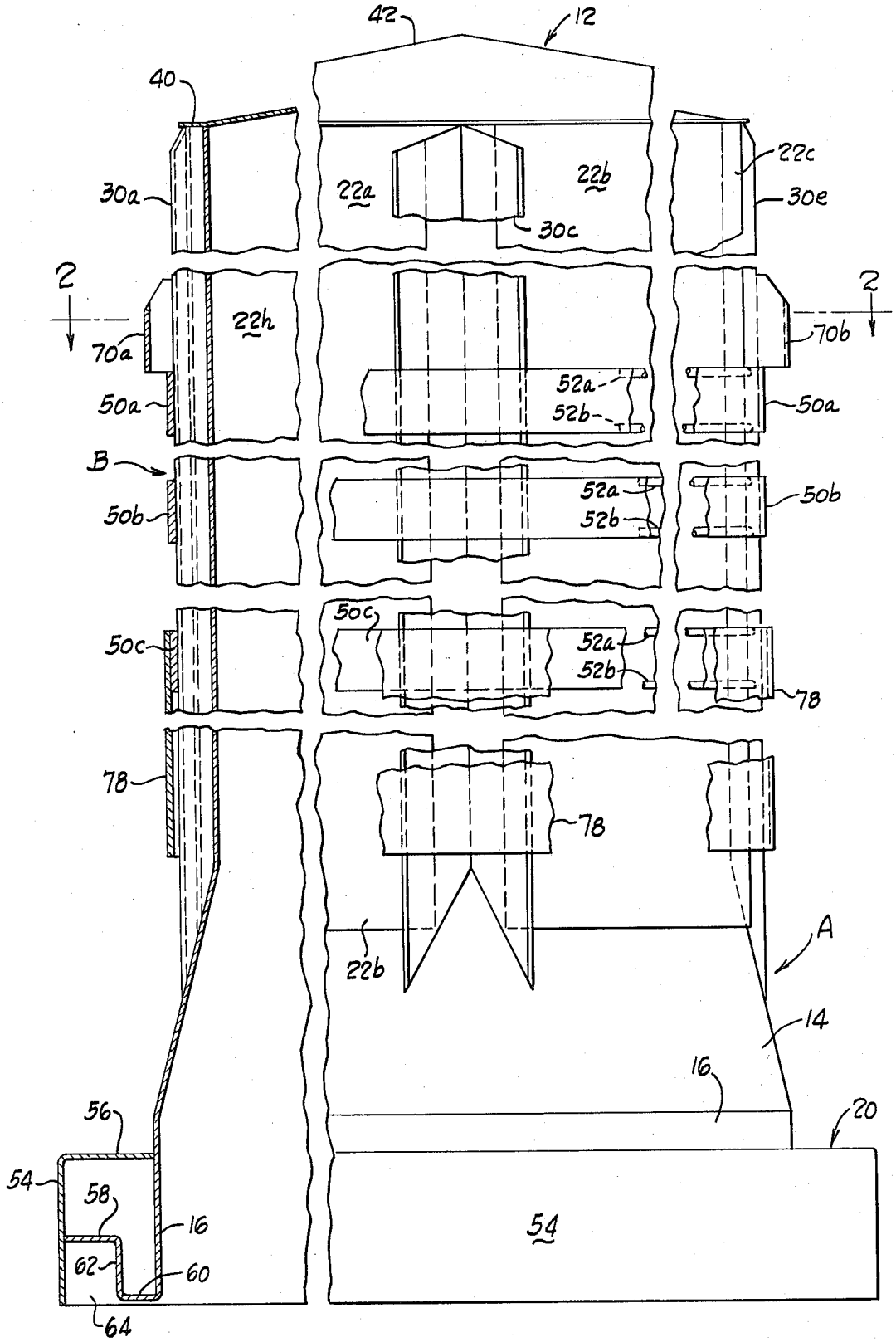
FIG. 1 is a side elevational view of a bell-type sheet metal annealing furnace inner cover embodying this invention with parts broken away and parts in section approximately on the line 1—1 of FIG. 2.
Figure 2:
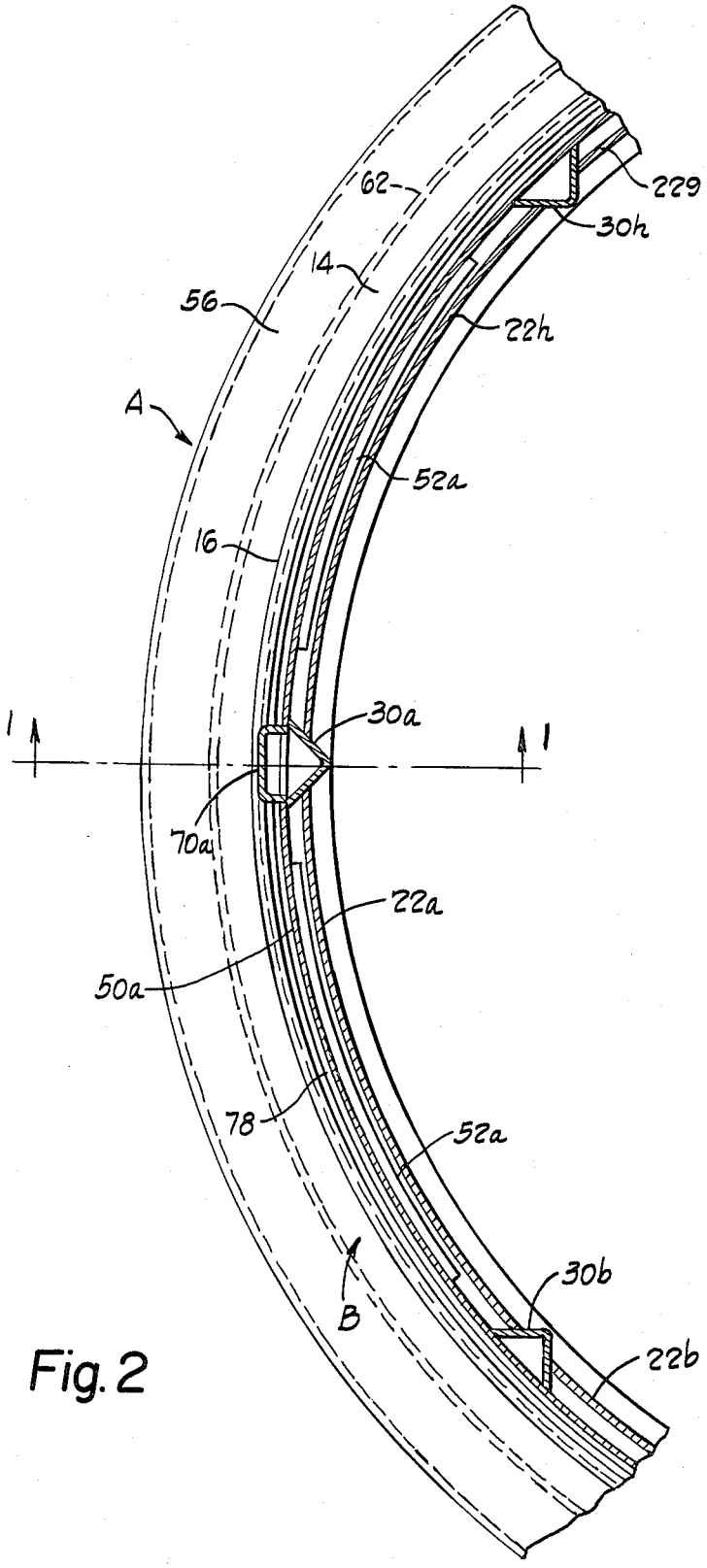
FIG. 2 is a fragmentary sectional view approximately on the line 2—2 of FIG. 1.

Referring to the drawing, the furnace inner cover depicted therein and designated generally by the reference character A comprises a body part B having a closed upper end 12. The lower end of the body part B of the depicted cover A terminates in the upper part of an outwardly flared conical member 14 the lower end of which is connected to a cylindrical member 16 forming a part of a base section 20. The cylindrical body B comprises eight (8) duplicate arcuate vertical panels 22 only five (5) of which designated 22*a*, 22*b*, 22*c*, 22*g*, 22*h* appear in the drawings welded to the adjoining sides of eight (8) duplicate vertical angle members 30 only five (5) of which designated 30*a*, 30*b*, 30*c*, 30*e*, 30*h* appear in the drawings. The conical member 14 can be omitted, if desired, in this event the panels 22 and the angle members 30 would terminate at the base section 20.

The apexes of the angle members 30 extend inwardly towards the center of the cylindrical body B and the panels 22 are welded to the outwardly extending flanges at the sides of the angle members where they overlap.

The upper end of the cylindrical body B of the inner cover A is closed by the integrally formed cover section 12 which comprises a flat ring-like integral area or member 40 engaging and welded to the upper ends of the panel members 22 and the angle members 30 and a conical area or member 42 the periphery of which is integrally formed with the inner diameter of the ring-like member 40.

The cylindrical body B may be reinforced by a number of horizontal bands 50 only three of which designated 50*a*, 50*b*, 50*c* are shown. The bands 50 encircle the body part or section B, engage the outer free edges of the flanges of the angle members 30 and are welded thereto. The bands 50 are each reinforced by a pair of arcuate round rod members 52*a* 52*b* welded to the interiors of the band members between the vertical angle members 30, or are produced from formed or extruded, structurally shaped material.

The lower ends of the panel members 22 and the angle members 30 are welded to the upper end of the conical member 14 the lower end of which is welded to a cylindrical member 16 forming a part of the base section 20 of the inner cover. The depicted base section 20 includes a second cylindrical member 54 of larger diameter than that of the member 16. The members 16, 54 are connected together by a flat top ring member 56 welded to their upper ends and by a Z-like member formed of two flat ring shaped plate members 58, 60 welded to the top and bottom ends of a vertical cylindrical member 62, respectively located midway between the members 16, 54 and about one half the height of the member 54. The member 58 is the larger diameter member of the members 58, 60 and with the members 54, 62 forms a downwardly opening circular channel 64 in the base section 20.

Four handle-like members 70 only three of which designated 70*a*, 70*b*, 70*c* are shown in the drawings are provided for the attachment of a grab or grabs for moving the inner cover A.

At least the parts 14, 16 and 22 and if desired the base section 20 of the inner cover are constructed of heat resistant metal, such as, a high heat resistant nickle chrome alloy or stainless steel. The panels 22 are geometric patterned textured metal sheets as this term is understood in the metal fabrication art. The panels 22 are of uniform or essentially uniform thickness and the thickness thereof may vary up to about one eighth of an inch ($\frac{1}{8}''$), and have a multiplicity of small projections on one or both sides and complimentary indentations or depressions in the other. The projections on one side of the panel are typically formed by making indentations or depressions in the other side. The projections and indentations are relatively small and shallow and may typically have a depth up to about two or three times the thickness of the material and are small in plan typically ranging between about twelve hundredths square inches (0.12 sq. in) and four tenths square inches (0.4 sq. in). The indentations may be any desired shape, for example, round, triangular, square, diamond etc.

The cover A when in use is positioned upon a suitable refractory lined furnace foundation structure provided with means for introducing the desired atmosphere into the interior of the cover, and the lower parts of the base section in this case provide a recess 64 and chamber above it for a water cooled rubber seal member. In other embodiments the base section could be designed for embedding in sand or suitable liquid or the use of refractory fiber all for the purpose of sealing the lower end of the cover against the excessive escape of the atmosphere therethrough. A circular flange forming a part of the foundation may extend upwardly into the channel 64 as a part of the seal. One of the features of the present inner cover is the fact that the lower end of the cover is further from the coil being annealed because of the flared construction of the member 14 than it would be if the body B of the cover was of uniform diameter throughout its length and therefore stays cooler and oxidizes less. In some cases this design approach allows the use of a mild steel for portions of the cover base section.

Another feature of the present inner-cover design is, when desired, the addition of an external heat resistant metal panel 78 in the lower portion of the vertical section of the body B to act as a heat shield to further reduce deterioration of the cover from the effects of direct firing burners. The depicted cover of the panel is detachably connected to the lower band 50C by bolts 80.

The terms "textured panel" and "textured panels" as used in the specification and claims hereof designate a panel or panels at least portions of which are "textured" as this term is understood in the metal fabrication art, i.e. a panel of uniform or essentially uniform wall thickness of about one-eighth of an inch ($\frac{1}{8}''$) or less and has a multiplicity of closely arranged small projections on one or both sides with complimentary small shallow indentations in the other having a depth of about two or three times the thickness of the material and a shape in plan which may be round, triangular, square, diamond and the like, and an area in plan of about twelve hundredths square inches (0.12 sq. in.) to four-tenths square inch (0.4 sq. in.).

From the foregoing description of the invention, it will be apparent that the objects heretofore mentioned and others have been accomplished and that there has been provided an inner cover for a bell-type annealing furnace which is relatively simple in construction, inexpensive to manufacture has a very high efficiency and which will have an unexpectedly long life in use.

While the preferred embodiment of the invention has been described in considerable detail, it is to be understood that the invention may be otherwise embodied and it is the intention to hereby cover all modifications thereof which come within the scope of the appended claims.

We claim:

1. A heat resistant stainless steel or alloy inner cover for a bell-type metal processing furnace comprising a generally cylindrical tubular body section including a plurality of circumferentially spaced longitudinally extending parallel angle iron members each extending the length of the generally cylindrical tubular body section and having their apexes orientated towards the center of the generally cylindrical tubular body section and a panel between each circumferentially spaced pair of angle iron members extending the length of the generally cylindrical tubular body section and connected to the flanges of the angle iron members at about their longitudinally extending centers, a member integral with and closing one end of said generally cylindrical tubular body section, and a plurality of metal bands spaced lengthwise of and surrounding said generally cylindrical tubular body section and welded to the free edges of the flanges of said angle iron members.

2. A heat resistant stainless steel or alloy inner cover for a bell-type metal processing furnace comprising a generally cylindrical tubular body section including a plurality of circumferentially spaced longitudinally extending parallel angle iron members each extending the length of the generally cylindrical tubular body section and having their apexes orientated towards the center of the generally cylindrical tubular body section and a textured panel between each circumferentially spaced pair of angle iron members extending the length of the generally cylindrical tubular body section and connected to the flanges of the angle iron members at about their longitudinally extending centers, a member integral with and closing one end of said generally cylindrical tubular body section, and a plurality of metal bands spaced lengthwise of and surrounding said generally cylindrical tubular body section and welded to the free edges of the flanges of said angle iron members.

3. A heat resistant stainless steel or alloy inner cover for a bell-type metal processing furnace comprising a generally cylindrical tubular body section including a plurality of circumferentially spaced longitudinally extending parallel angle iron members each extending the length of the generally cylindrical tubular body section and having their apexes orientated towards the center of the generally cylindrical tubular body section and a textured panel extending the length of the generally cylindrical tubular body section between each circumferentially spaced pair of angle iron members and connected to the flanges of the angle iron members at about their longitudinally extending centers, a member integral with and closing one end of said generally cylindrical tubular body section, an outwardly flaring tubular member connected to the end of said generally cylindrical tubular body section opposite said closed end thereof and a plurality of metal bands spaced lengthwise of and surrounding said cylindrical tubular body section and welded to the free edges of the flanges of said angle iron members.

4. An inner cover for a metal processing furnace as claimed in claims 1, 2 or 3 in which the lower portion of the generally cylindrical tubular body section has an external heat resistant metal circuit panel connected thereto and surrounding the same to act as a heat shield.

5. A heat resistant stainless steel or alloy inner cover for a bell-type metal processing furnace comprising a generally cylindrical tubular body section including a plurality of circumferentially spaced longitudinally extending parallel angle iron members each extending the length of the generally cylindrical tubular body section and having their apexes orientated towards the center of the generally cylindrical tubular body section and a textured panel between each circumferentially spaced pair of angle iron members and extending the length of the generally cylindrical tubular body section and connected to the flanges of the angle iron members at about their longitudinally extending centers, a member integral with and closing one end of said generally cylindrical tubular body section, a plurality of metal bands spaced lengthwise of and surrounding said generally cylindrical tubular body section and welded to the free edges of the flanges of said angle iron members, an outwardly flaring tubular member connected to the end of said generally cylindrical tubular body section opposite to said closed end thereof, and a generally cylindrical tubular-like base member connected to the flaring end of said outwardly flaring tubular member.

* * * * *

UNITED STATES PATENT AND TRADEMARK OFFICE

CERTIFICATE OF CORRECTION

PATENT NO. : 4,278,242

DATED : July 14, 1981

INVENTOR(S) : William P. Freund and Stephen R.Hulvey

It is certified that error appears in the above—identified patent and that said Letters Patent is hereby corrected as shown below:

Column 5, line 21 - change "circuit" to --circular--.

Signed and Sealed this

*Eighth* Day of *December 1981*

[SEAL]

*Attest:*

GERALD J. MOSSINGHOFF

*Attesting Officer*

*Commissioner of Patents and Trademarks*